US006827606B2

(12) United States Patent
Endoh

(10) Patent No.: US 6,827,606 B2
(45) Date of Patent: Dec. 7, 2004

(54) CONNECTOR WITH MOUNTING RIBS FOR MOUNTING TO A CIRCUIT BOARD

(75) Inventor: Takeshi Endoh, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/282,330

(22) Filed: Oct. 29, 2002

(65) Prior Publication Data

US 2003/0104729 A1 Jun. 5, 2003

(30) Foreign Application Priority Data

Nov. 30, 2001 (JP) ..... 2001-366956

(51) Int. Cl.[7] ..... H01R 13/73
(52) U.S. Cl. ..... 439/573
(58) Field of Search ..... 439/573, 572, 439/571, 564, 565, 74

(56) References Cited

U.S. PATENT DOCUMENTS 6,244,909 B1 6/2001 Okada et al. ..... 439/844
6,409,540 B1 * 6/2002 Kodama ..... 439/573

* cited by examiner

*Primary Examiner*—Son V. Nguyen
(74) *Attorney, Agent, or Firm*—Harness, Dickey & Pierce P.L.C.

(57) ABSTRACT

A connector-mounting construction has a printed-circuit board (2) and a connector (4) fastened to each other with a screw (5). The connector (4) has a positioning rib (4*a*) positioned in a positioning rib hole (2*a*) on the printed-circuit board (2). The positioning rib (4*a*) is disposed so that a peripheral surface of the positioning rib (4*a*) contacts a peripheral surface of the screw (5) to fasten the printed-circuit board (2) and the connector (4) to each other.

2 Claims, 5 Drawing Sheets

CONNECTOR WITH MOUNTING RIBS FOR MOUNTING TO A CIRCUIT BOARD

CROSS-REFERENCE TO RELATED APPLICATIONS

This application claims priority to Japanese Patent Application Nos. JP 2001-366956, filed Nov. 30, 2001, which application is herein expressly incorporated by reference.

FIELD OF THE INVENTION

The present invention relates to a connector-mounting construction to be mounted on a junction block of a vehicle body.

BACKGROUND OF THE INVENTION

When a junction block (electric connection box) is connected to an electronic control unit, as shown in FIG. 1, a connector 4 of a so-called junction direct connection type is frequently used. More specifically, tab terminals 7*a* erectly arranged in a row on bus bars 7 of a junction block 1 are directly inserted into terminal insertion holes 4*h* of a connector 4 mounted on a printed-circuit board 2 of an electronic control unit 3. This electrically connects the tab terminals 7*a* and the connector 4 to each other.

To penetrate all the tab terminals 7*a* through the printed-circuit board 2, as shown in FIG. 7, a long and narrow slit 8 and a pair of screw holes 2*b* are formed on the printed-circuit board 2. The connector 4 can be mounted on the printed-circuit board 2 by passing screws into the screw holes 2*b* and a pair of screw holes 4*b* formed at the front and rear ends of the connector 4. The screw holes 2*b* and 4*b* are thus superimposed on one another.

In mounting the connector 4 on the printed-circuit board 2, there may be a deviation between the connector 4 and the slit 8 because of an error in the position and diameter of the screw hole 4*b* of the connector 4, an error in the position and diameter of the screw hole 2*b* of the printed-circuit board 2, and an error in an unshown screw. To solve this problem, in recent years, the following technique has been developed. As shown in FIG. 8, to correctly insert the tab terminals 7*a* into the connector 4, a pair of positioning ribs 4*a* is formed on the connector 4. Also, a pair of positioning rib holes 2*a*, corresponding to the positioning ribs 4*a*, is formed on the printed-circuit board 2. The positioning ribs 4*a* are fitted on the positioning rib holes 2*a* to position the connector 4.

However, in the conventional art, component parts and wiring patterns cannot be disposed in certain areas on the periphery of the screw hole 2*b* and the positioning rib hole 2*a* both of which are formed on the printed-circuit board 2. Thus, the conventional art is incapable of utilizing the space efficiently.

SUMMARY OF THE INVENTION

The present invention has been made in view of the above-described problem. Accordingly, it is an object of the present invention to provide a connector-mounting construction which enables a connector to be accurately positioned on a printed-circuit board and the space of the printed-circuit board to be utilized efficiently.

To achieve the object, a connector-mounting construction includes a printed-circuit board and a connector fastened to each other by a screw. The connector is positioned on the printed-circuit board by fitting a positioning rib, formed on the connector, in a positioning rib hole, formed on the printed-circuit board. The positioning rib is disposed so that a peripheral surface of the positioning rib of the connector contacts a peripheral surface of the screw to fasten the printed-circuit board and the connector to each other.

In the present invention, the peripheral surface of the positioning rib of the connector contacts the peripheral surface of the screw, which fastens the printed-circuit board and the connector to each other. Thus, it is possible to minimize the area of the printed-circuit board on the periphery of a screw hole and the positioning rib hole where component parts and wiring patterns cannot be disposed. Therefore, the connector-mounting construction of the present invention is capable of utilizing the space efficiently.

In a preferable mode of the present invention, a projection amount of the positioning rib from the connector is set smaller than a thickness of the printed-circuit board. Also, the screw is tightened into the connector from a rear side of the printed-circuit board through the printed-circuit board.

In the above preferable mode of the present invention, the projection amount of the positioning rib 4*a* from the connector is set smaller than the thickness of the printed-circuit board. Thus, it is possible to prevent the positioning rib and the screw from interfering with each other. Further, the screw is tightened into the connector from the rear side of the printed-circuit board through the printed-circuit board. Therefore, unlike the case where the screw is tightened into the printed-circuit board from the connector side through the connector, through the printed-circuit board and through the positioning rib, there is no discontinuity of component parts in the portion in which the screw is tightened. Thus. the printed-circuit board and the screw can be firmly fastened to each other.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
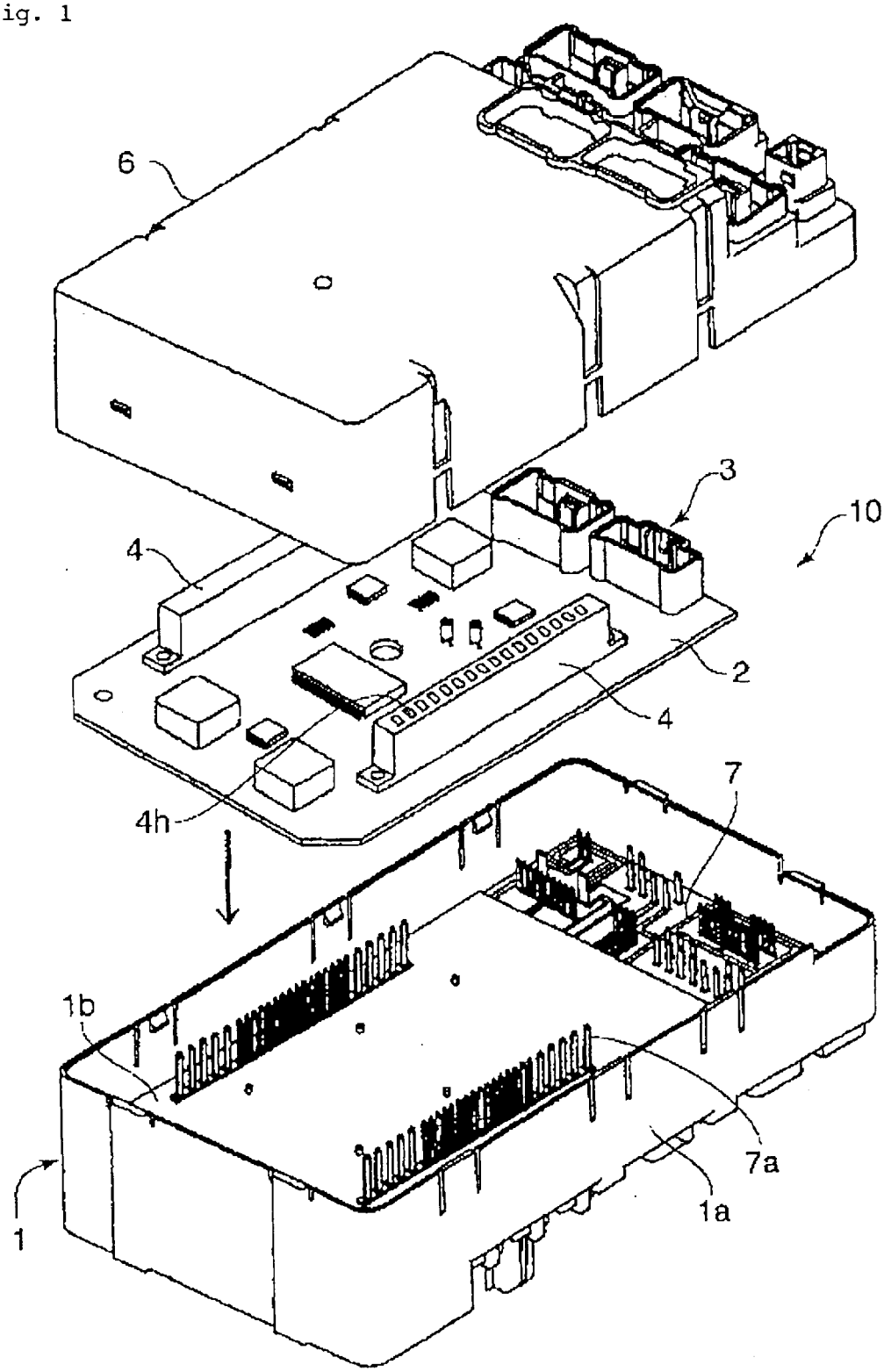
FIG. 1 is an exploded perspective view of a connector mounted on a printed-circuit board of an electronic control unit to be incorporated in a junction block according to the present invention.

The embodiments of the present invention will be described below with reference to drawings. FIG. 1 is an exploded perspective view of a construction where a connector 4 is mounted on a printed-circuit board 2 of an electronic control unit 3. The unit is incorporated in a junction block 1 as an example of application of a connector-mounting construction 10 according to an embodiment of the present invention.

Figure 2:
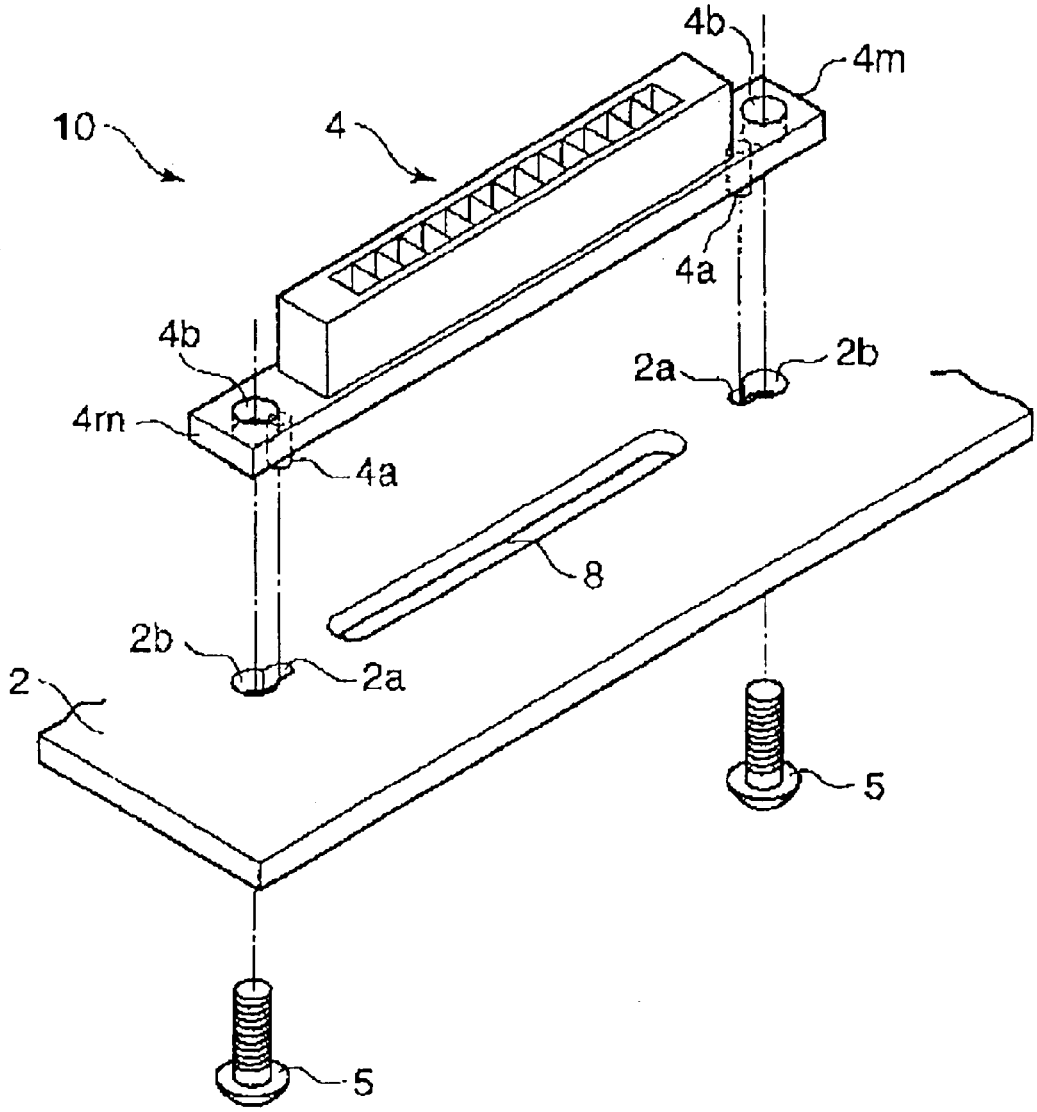
FIG. 2 is an exploded perspective view of the connector-mounting construction according to the present invention.
Figure 3:
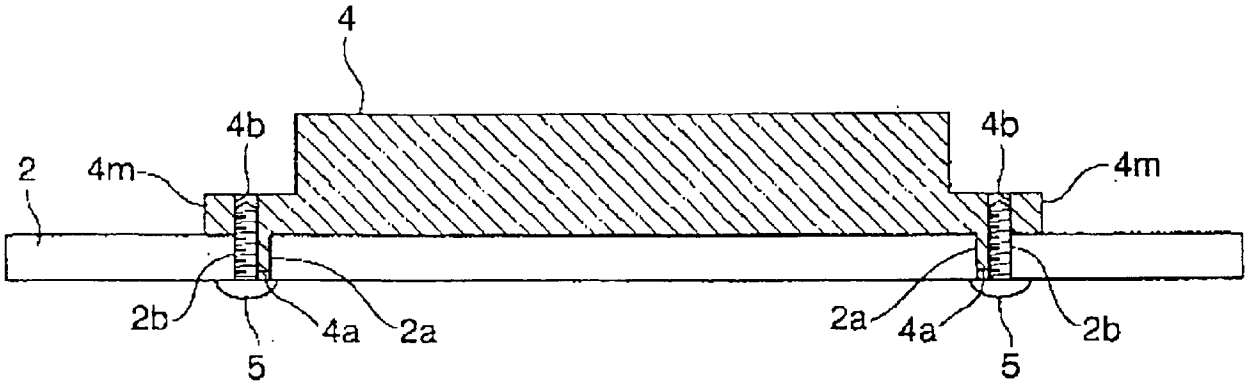
FIG. 3 is a sectional view of the connector-mounting construction according to the present invention.
Figure 4:
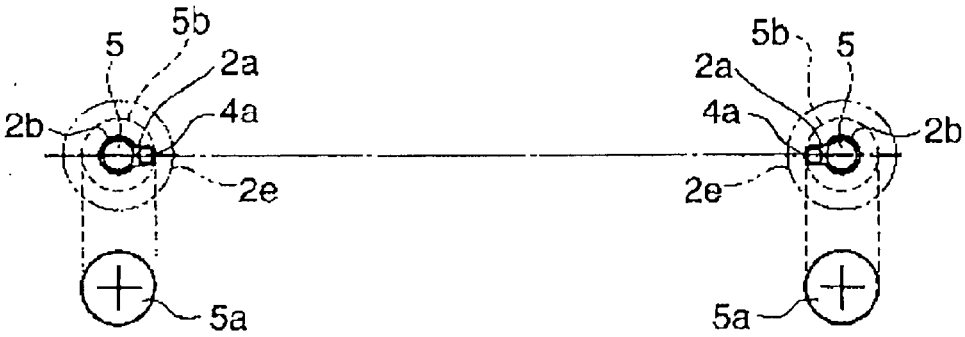
FIG. 4 is a bottom plan view of a positioning rib and a screw hole formed on the printed-circuit board of the connector-mounting construction.
Figure 5:
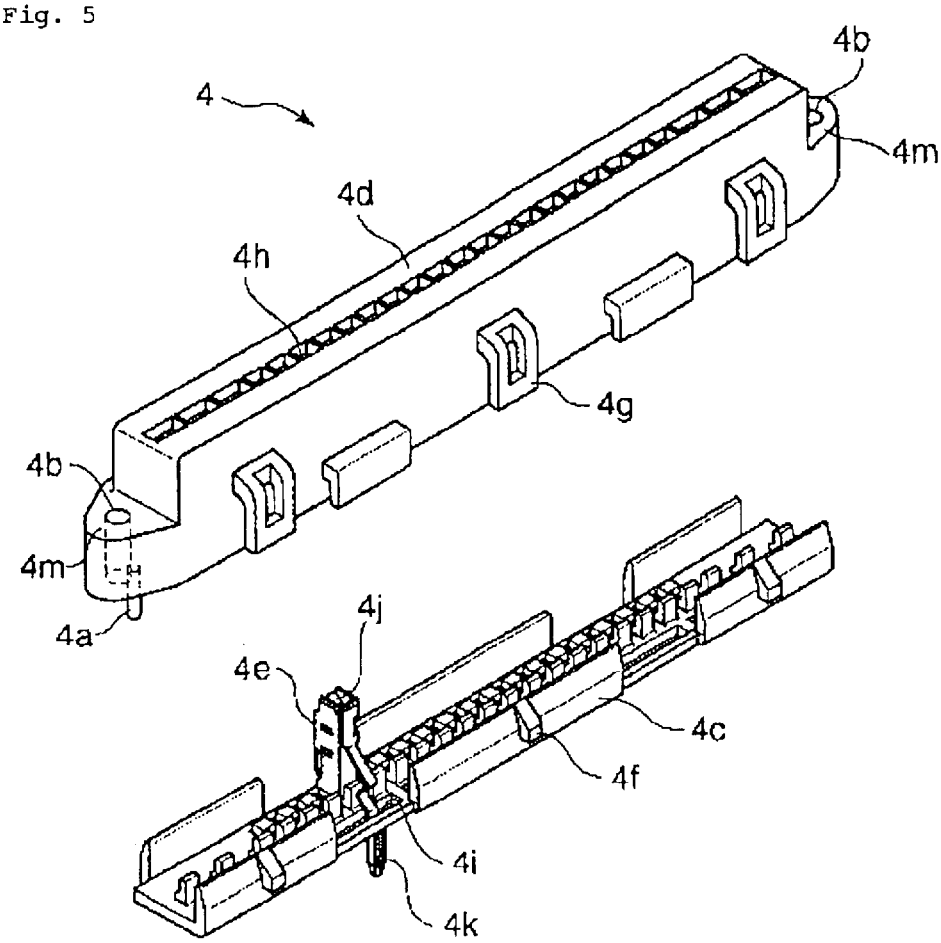
FIG. 5 is an exploded perspective view of the connector to be used in the connector-mounting construction.
Figure 6:
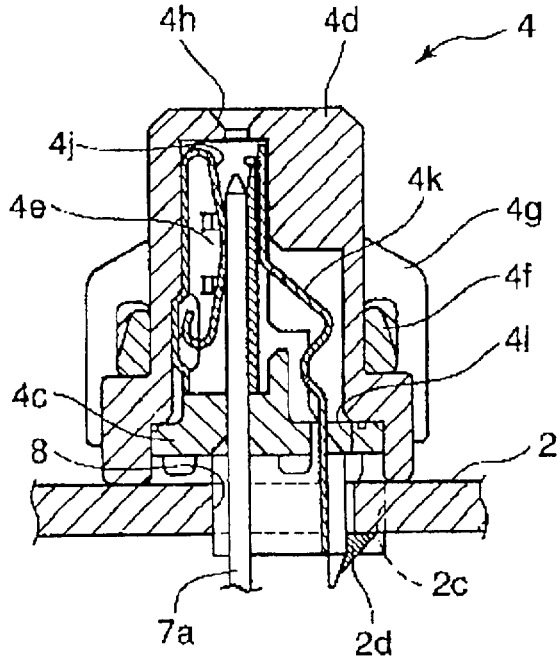
FIG. 6 is a sectional view showing the connector to be used in the connector-mounting construction.
Figure 7:
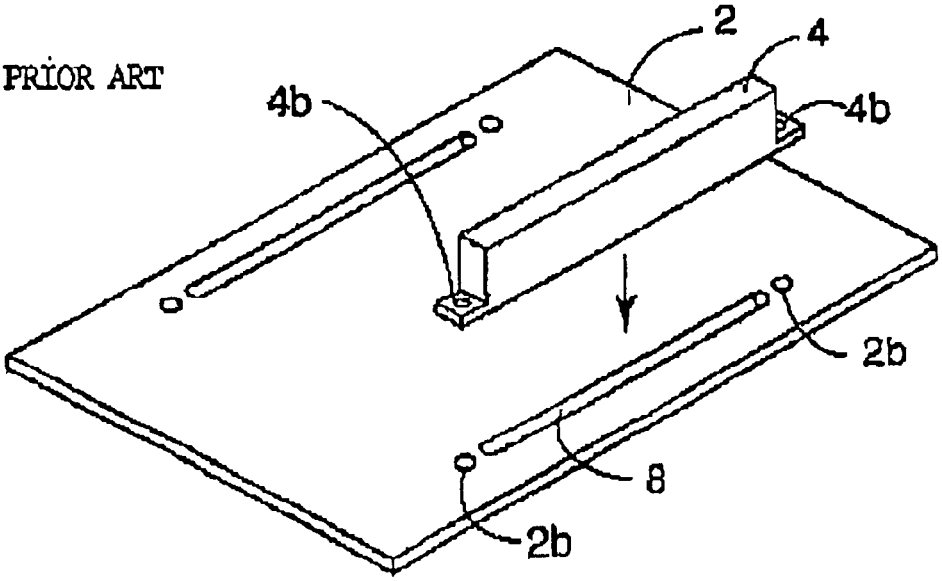
Fig. 7 PRIOR ART
FIG. 7 is a perspective view of an example of a prior art connector-mounting construction.
Figure 8:
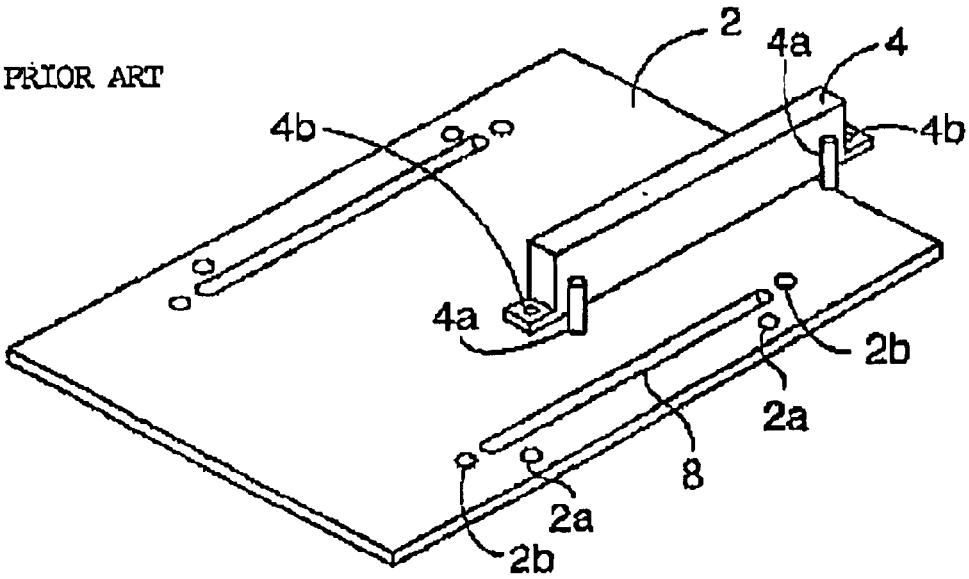
Fig. 8 PRIOR ART
FIG. 8 is a perspective view of another example of a prior art connector-mounting construction.

FIG. 2 is an exploded perspective view of the connector-mounting construction 10 according to the embodiment. FIG. 3 is a sectional view of the connector-mounting construction 10 according to the embodiment. FIG. 4 shows a positioning rib 2*a* and a screw hole 2*b* formed on the printed-circuit board 2 of the connector-mounting construction 10 in a direction from a bottom surface of the printed-circuit board 2. FIG. 5 is an exploded perspective view of the connector 4 to be used in the connector-mounting construction 10 according to the embodiment. FIG. 6 is a sectional perspective view of the connector 4 to be used in the connector-mounting construction 10 according to the embodiment.

With reference to FIG. 1, a connector-mounting construction 10 is provided to mount a connector 4 of a so-called junction direct connection type on a printed-circuit board 2 of an electronic control unit 3. The control unit 3 is incorporated in a junction block 1 of a vehicle.

The junction block 1 is box-shaped and combined with a cover 6 to accommodate electronic parts. Bus bars 7 which serves as a wiring material are accommodated between a case 1*a* and a partitioning plate 1*b* through an insulation layer. A plurality of tab terminals 7*a* are projected in a row in a certain range from an upper surface of the bus bars 7. The tab terminals 7*a* penetrate through the partitioning plate 1*b*.

The electronic control unit 3 has a printed-circuit board 2 on which electronic parts and circuits are formed. When the electronic control unit 3 is incorporated in the junction block 1, the projecting tab terminals 7*a* on the upper surface of the bus bars 7 and the connector 4, formed on the printed-circuit board 2, are electrically connected to each other.

The connector 4 is disposed on an upper surface of the printed-circuit board 2. The connector 4 is connected to the tab terminals 7*a* to electrically connect the bus bars 7 and the electronic control unit 3 to each other. In the embodiment, two long and narrow connectors 4, having the same construction, are mounted on the printed-circuit board 2. One of the connectors 4 is disposed at the right side of the circuit board 2 and the other connector 4 is disposed at the left side of the circuit board 2.

With reference to FIG. 2, a long and narrow slit 8 is formed on the printed-circuit board 2. The slit 8 enables all of the tab terminals 7*a* to penetrate through the partitioning plate 1*b*. The slit 8 and the connectors 4 are parallel with each other enabling the tab terminals 7*a* to penetrate the partitioning plate 1*b* and couple with the connector 4.

The connector-mounting construction 10 of the embodiment has a positioning rib 4*a* formed on the connector 4. A positioning rib hole 2*a* is formed on the printed-circuit board 2 on which the connector 4 is mounted. The connector 4 is positioned on the printed-circuit board 2 by fitting the positioning rib 4*a* into the positioning rib hole 2*a*. The printed-circuit board 2 and the connector 4 are fastened to each other by a screw 5. As shown in FIG. 3, the positioning rib 4*a* is disposed so that the peripheral surface of the positioning rib 4*a* contacts the peripheral surface of the screw 5. This fastens the printed-circuit board 2 and the connector 4 to each other.

A flange 4*m* to mount the connector 4 on the printed-circuit board 2 projects from both ends of the connector 4 in the longitudinal direction. A pair of screw holes 4*b* to screw the connector 4 to the printed-circuit board 2 is formed on the flange 4*m*. The columnar positioning rib 4*a* to position the connector 4 on the printed-circuit board 2 projects downward from a bottom surface of the flange 4*m*. Accordingly, the positioning rib 4*a* is adjacent to the screw hole 4*b*.

The printed-circuit board 2 has screw hole 2*b* at a position on the printed-circuit board 2 corresponding to each end of the connector 4 in its longitudinal direction. The printed-circuit board 2, screw hole 2*b* enables a screw to secure the connector 4 to the printed-circuit board 2. The printed-circuit board 2 has a positioning rib hole 2*a* to receive the positioning rib 4*a*. The screw hole 2*b* and the positioning rib hole 2*a* are adjacent to each other.

The connector 4 is disposed on the printed-circuit board 2 so as to straddle the slit 8 of the printed-circuit board 2. The positioning rib 4*a* and the positioning rib hole 2*a*, formed on the printed-circuit board 2, are fitted on each other to position the connector 4 on the printed-circuit board 2. In this state, the screw hole 4*b* of the connector 4 and the screw hole 2*b* formed on the printed-circuit board 2 are superimposed on each other. This enables the printed-circuit board 2 and the connector 4 to be fastened to each other with the screw.

In the embodiment, the amount of the positioning rib 4*a* projecting from the connector 4 is smaller than the thickness of the printed-circuit board 2. The screw 5 is tightened into the connector 4 from the rear side of the printed-circuit board 2 through the printed-circuit board 2.

The present invention does not limit the specifics of the inner construction of the connector 4. For example, as shown in FIGS. 5 and 6, the connector 4 may have a base member 4*c*, made of resin, a cover member 4*d*, made of resin, and a female metal fitting, made of metal. A projection 4*f*, formed on the base member 4*c*, is fitted on a claw 4*g*, formed on the cover member 4*d*, at a position corresponding to the position of the projection 4*f*. This integrates the cover member 4*d* and the base member 4*c* with each other.

In this example, the female metal fitting 4*e*, of the connector 4, is formed by squarely bending an electrically conductive thin plate. A tab terminal 7*a* can be inserted into the female metal fitting 4*e*. The tab terminal 7*a* passes through a terminal insertion hole 4*h* formed on the cover member 4*d*, a through-hole 4*i* formed on the base member 4*c*, and the slit 8 formed on the printed-circuit board 2.

A part of the upper end of the female metal fitting 4*e* is folded inward to form a tongue-like spring piece 4*j*. The tab terminal 7*a* may be inserted into the spring piece 4*j*. A connection piece 4*k* extends outward from the female metal fitting 4*e*. The connection piece 4*k* is positioned opposite to the tongue-like spring piece 4*j*. The connection piece 4*k* is connected to a printed wiring 2*c* (see FIG. 6) and a solder 2*d* formed on the printed-circuit board 2.

The operation of the embodiment is described below with reference to FIGS. 2, 3, and 4.

In the connector-mounting construction 10 of the embodiment, the connector 4 is mounted on the printed-circuit board 2 of the electronic control unit 3. With reference to FIGS. 2 and 3, the connector 4 is placed in position above the printed-circuit board 2. The positioning rib 4*a*, formed on the connector 4, confronts the positioning rib hole 2*a* formed on the printed-circuit board 2, on which the connector 4 is mounted. With the printed-circuit board 2 and the connector 4 superimposed on each other, the positioning rib 4*a* is fitted into the positioning rib hole 2*a*.

In this state, to penetrate all the tab terminals 7*a* (see FIG. 1) arranged in a row, through the partitioning plate 1*b*, the connector 4 and the long and narrow slit 8 formed on the printed circuit board 2 are parallel with each other. This enables the tab terminals 7*a* to penetrate through the partitioning plate 1*b*.

With the connector 4 positioned on the printed-circuit board 2, by fitting the positioning rib 4*a* in the positioning rib hole 2*a*, the screw hole 4*b* of the connector 4 and the screw hole 2*b* formed on the printed-circuit board 2 are superimposed with each other. Accordingly, the printed-circuit board 2 and the connector 4 can be fixed to each other by the screw.

With the connector 4 positioned on the printed-circuit board 2 and with both screw holes 2*b* placed in position, the screw 5 is tightened into the screw hole of the connector 4 from the rear side of the printed-circuit board 2. The peripheral surface of the positioning rib 4*a* of the connector 4 and the peripheral surface of the screw 5 contact each other. Thereby the printed-circuit board 2 and the connector 4 are fastened to each other.

In this state, as shown in FIG. 4, the peripheral surface of the positioning rib 4*a* of the connector 4 and the peripheral surface of the screw 5 contact each other. Thus the periphery of the positioning rib 4*a* is disposed inside a boundary line 5*b* of a screw head 5*a*. The area of the range 2*e* where the component parts and wiring patterns cannot be disposed is minimized on the printed-circuit board 2.

As shown in FIG. 6, the connection piece 4*k* extended outward from the female metal fitting 4*e* of the connector 4. The connection piece 4*k* projects from the rear (lower) surface of the printed-circuit board 2 through the slit 8. The connection piece 4*k* is connected to the printed wiring 2*c* and the solder 2*d* formed on the rear surface of the printed-circuit board 2. Thereby the connector 4 is electrically connected to electronic parts and circuits disposed on the printed-circuit board 2 of the electronic control unit 3.

When the electronic control unit 3 is incorporated in the junction block 1, the tab terminals 7*a*, projecting from the upper surface of the bus bars 7, are connected to the connector 4 formed on the printed-circuit board 2 of the electronic control unit 3. This occurs by inserting the tab terminals 7*a* into the lower portion of the connector 4. Thus, the tab terminals 7*a* are fitted on the female metal fittings 4*e* disposed inside the connector 4. The tab terminals 7*a* are electrically connected to the printed wiring 2*c* of the printed-circuit board 2 through the tongue-like spring piece 4*j* and the connection piece 4*k* of the female metal fitting 4*e*. Thus the electrical connection between the electronic control unit 3 and the junction block 1 is complete.

As described above, according to the embodiment, in mounting the connector 4 on the printed-circuit board 2, the positioning ribs 4*a* fit into the two positioning rib holes 2*a* on the printed-circuit board 2. Accordingly, it is easy to position the connector 4 on the printed-circuit board 2. This make the connector 4 and the slit 8 parallel with each other with high accuracy. Thus it is possible to prevent a deviation of the connector 4 with respect to the printed-circuit board 2 from exceeding an allowed value. Further, once the connector 4 is placed in position, it can be kept in a stable posture. Therefore the tab terminals 7*a* can be smoothly inserted into the connector 4. The electronic control unit 3 can be mounted on the junction block 1 with ease and at high efficiency.

Further in the embodiment, since the peripheral surface of the positioning rib 4*a* of the connector 4 contacts the peripheral surface of the screw 5 to fasten the printed-circuit board 2 and the connector 4 to each other, the area in the range where the component parts and wiring patterns cannot be disposed is minimized on the printed-circuit board 2. Thus the connector-mounting construction of the present invention is capable of utilizing the space efficiently.

In the embodiment, the amount of the positioning rib 4*a* that extends from the connector 4 is smaller than the thickness of the printed-circuit board 2. Thus it is possible to prevent the positioning rib 4*a* and the screw 5 from interfering with each other. Further the screw 5 is tightened into the connector 4 from the rear side of the printed-circuit board 2 through the printed-circuit board 2. Therefore unlike the case in where the screw 5 is tightened into the printed-circuit board 2 from the connector side, through the connector 4, there is no discontinuity of component parts in the portion where the screw 5 is tightened. Thus, the printed-circuit board 2 and the screw 5 can be firmly fastened to each other.

The above-described embodiment is merely an example of the preferred embodiments of the present invention. The present invention is not limited to the above-described embodiment.

For example, the screw 5 does not necessarily have to be tightened into the connector 4 from the rear side of the printed-circuit board 2 through the printed-circuit board 2. The screw 5 may be tightened into the printed-circuit board 2 from the connector side through the connector 4. In this case, the printed-circuit board 2 and the screw 5 can be fastened to each other with sufficient strength and precision.

In the embodiment, as shown in FIG. 2, the positioning rib 4*a* is eccentric with the screw 5 and disposed inward from the screw 5. However, so long as the positioning rib 4*a* is disposed in contact with the peripheral surface of the screw 5, the position of the positioning rib 4*a* can be selected as desired.

The inner construction of the connector 4 is not limited to the mode shown in the drawings. The slit 8 does not necessarily have to be formed on the printed-circuit board 2. The connector 4 may be constructed so that the tab terminals 7*a* are inserted downward into the connector 4.

The positioning rib 4*a* does not necessarily have to be columnar. The rib 4*a* may have any desired shape which contacts the peripheral surface, of the screw 5. For example, the positioning rib 4*a* may have a square pillar-shape.

In any of the above cases, in mounting the connector 4 on the printed-circuit board 2, the positioning rib 4*a* fits into the two positioning rib holes 2*a* formed on the printed-circuit board 2. Thus, it is easy to position the connector 4 on the printed-circuit board 2.

In the above-described embodiment, the connector 4 has been described as the so-called junction direct connection type. However, the connector 4 may be of a different type so long as the printed-circuit board 2 and the connector 4 are fastened to each other with the screw 5. The connector 4 is positioned on the printed-circuit board 2 by fitting the positioning rib 4*a*, formed on the connector 4, into the positioning rib hole 2*a*, formed on the printed-circuit board 2.

In the above-described embodiment, the connector-mounting construction is used to mount the electronic control unit 3, for use in a vehicle body, on the junction block 1. However, it is possible to alter the design of the connector-mounting construction. For example, the connector-mounting construction is applicable for installation of an electronic control unit of a household appliance.

As apparent from the foregoing description, according to the present invention, it is possible to minimize the area of the printed-circuit board where component parts and wiring patterns cannot be disposed. Therefore the connector-mounting construction of the present invention is capable of utilizing the space efficiently.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A connector-mounting construction comprising:

a connector and a printed-circuit board on which said connector is mounted, said connector and printed-circuit board being fastened to each other with at least one screw;

at least one positioning rib formed on said connector for a positioning said connector on said printed circuit board;

at least one positioning rib hole communicates with at least one screw hole formed on said printed-circuit board for receiving said at least one positioning rib and screw, respectively; and said at least one positioning rib disposed so that at least a portion of an outer peripheral surface of said at least one positioning rib off said connector contacts at least a portion of a thread of a peripheral surface of said at least one screw for fastening said printed-circuit board and said connector to each other.

2. The connector-mounting construction according to claim 1, wherein a length of said at least one positioning rib projecting from said connector is smaller than a thickness of said printed-circuit board, and said at least one screw is tightened into said connector from a rear side of said printed-circuit board through said printed-circuit board.

* * * * *